United States Patent [19]

Girimont

[11] Patent Number: 4,660,397

[45] Date of Patent: Apr. 28, 1987

[54] KEY HOLDER WITH KEY EJECTING MEANS

[76] Inventor: John V. Girimont, 6 Redstart Path, Hilton Head Island, S.C. 29928

[21] Appl. No.: 791,095

[22] Filed: Oct. 24, 1985

[51] Int. Cl.[4] ..... A44B 15/00; A47G 29/10

[52] U.S. Cl. ..... 70/456 R; 70/456 B

[58] Field of Search ..... 70/456 R, 456 B, 457–459; 292/103, 107, 204, 209; 30/152, 155, 158

[56] References Cited

U.S. PATENT DOCUMENTS

| | | | |
|---|---|---|---|
| 1,170,433 | 2/1916 | Ellebrecht | 30/155 |
| 1,372,579 | 3/1921 | Weishaupt | 30/155 |
| 1,859,276 | 5/1932 | Bates | 70/456 R |
| 2,287,521 | 6/1942 | Handley | 150/40 |
| 2,412,056 | 12/1946 | Mosch | 70/456 |
| 2,550,375 | 4/1951 | Pentek | 70/456 R |
| 2,795,128 | 6/1957 | Ly | 70/456 R |
| 3,127,918 | 4/1964 | McElvain | 150/40 |
| 3,427,834 | 2/1969 | Tutino | 70/456 R |
| 3,696,649 | 10/1972 | Chow et al. | 70/456 R |
| 3,745,799 | 7/1973 | Fagiano | 70/456 R |
| 4,348,881 | 9/1982 | Toyoda | 70/456 R |
| 4,525,928 | 7/1985 | Foster | 30/158 |

*Primary Examiner*—Gary L. Smith
*Assistant Examiner*—Suzanne L. Dino
*Attorney, Agent, or Firm*—W. C. Tupman

[57] ABSTRACT

A key holder capable of compactly storing and selectively ejecting a multiplicity of flat keys. The key holder is provided with an actuator and an ejector assembly for moving the keys outwardly from each side, thus ejecting only the desired key from the holder. Stored keys are prevented from undesired movement by use of a divider and the prickly side of a Velcro strip. The key holder is capable of handling keys of various lengths, with its top and bottom cover members made from either hard plastic material or from metal.

17 Claims, 13 Drawing Figures

KEY HOLDER WITH KEY EJECTING MEANS

BACKGROUND OF THE INVENTION

Heretofore, key holders have been of the retaining loop type or the like, so that when one key is in use, the remaining keys dangle and rattle, which may cause distraction while driving and which may scratch the automobile dashboard, door or trunk lid or a house door. In most key holders, selecting the desired key requires sorting through a number of keys, which can be difficult in the absence of adequate light and may be impossible if only one hand is free. Existing key holders are bulky and tend to wear out pockets, gouge the body and become unsightly when worn. In other enclosed key holders, usually made of leather and having multiple loops, only storage is provided; hence the user must snap the holder open, select the desired key, place it in a position of utilization and snap the holder closed, thereby requiring several separate and independent steps and the use of both hands. This type of holder dangles when one key is in use and often touches the knee annoyingly when dangling from the automobile ignition. In this type of holder, loops tend to wear out and become detached, while the case deteriorates and becomes unsightly. Prior art key holders which provide for key ejection have an undesirably large number of moving parts and require two-hand operation, as well as a light, with the ejector acting on the body of the key, thereby causing wear and eventual malfunctioning of the key. Also, these key holders are not compact and thus tend to present an unattractive appearance.

OBJECTS OF THE INVENTION

The invention is concerned primarily with an attractive and compact key holder for retaining and ejecting a multiplicity of flat keys of various lengths, selection of any one key being obtained by mere thumb pressure on a cover mounted actuator.

The principal object of the invention is the provision of a key holder adapted to isolate a key in a position of utilization while unwanted keys are restrained inside the holder, thereby preventing swinging, rattling or scratching of adjacent surfaces.

An important object of the invention is the provision of key restraining means, such as a layer of fabric pile material, for retaining keys not in use and a divider for separating stored keys and for guiding and forcing a key into engagement with the fibers of pile material.

Another important object of the invention is the provision of spacers to maintain proper distances between members.

Another object of the invention is the provision of brass washers for key bearing surfaces.

Still another object of the invention is the provision of a non-corrosive metal shaft having a flange and threaded ends.

Still another object of the invention is the provision of a key holder utilizing either special, standardized, flat keys or modified, conventional, flat keys to attain compactness, standardization of holder dimensions and consistency of operation.

A more specific object of the invention is the provision of a key holder having an ejector comprised of discs of different diameters to provide selectivity in key ejection.

Another object of the invention is the provision of various key holders adapted to hold a number of keys ranging anywhere from a single key to a large plurality of keys.

Another specific object of the invention is the provision of a cover mounted actuator which is connected to an ejector by means of a shaft.

Another specific object of the invention is the provision of a V-shaped slot strategically located in the key holder top cover.

Another specific object of the invention is the provision of a helical spring attached on one end to a spring mounting tab separating the ejector discs and attached on the opposite end to a top cover spring anchor.

Another specific object of the invention is the provision of cylindrical posts for maintaining the covers in a spaced relationship and giving support for mounting the keys.

Another specific object of the invention is the provision of a key isolator to separate keys on the left from keys on the right.

Another specific object of the invention is the provision of a plurality of machine screws for securing the bottom cover to a like number of mounting posts.

Another specific object of the invention is the utilization of either a standardized key having a circular eye and a standard head length and configuration or a conventional key which has been modified to these standardized dimensions.

Still a further specific object of the invention is the provision of shim washers and spacers.

Still a further specific object of the invention is the provision of post extenders.

SUMMARY OF THE INVENTION

This invention overcomes most of the shortcomings of existing key holders in that it confines all of the keys in an attractive, compact case that selectively exposes the key to be utilized, thereby eliminating dangling, rattling and scratching of valued adjacent surfaces and permitting key selection and utilization with only one hand, without actually having to see the desired key. The key holder utilizes a spring biased actuator moving through a V-shaped slot in the top cover to pivot the keys outwardly from the holder. Keys are retained inside the holder by the utilization of a pressure plate which forces the keys into a holding engagement with the prickly sides of the Velcro strips embedded in the underside of both top and bottom covers which are positioned opposite each key. Ultimate compactness is achieved through the utilization of specially manufactured flat keys which are trimmed of unnecessary metal and have standardized head dimensions and a configuration to match the contour of the actuator. Conventional flat keys can also be utilized by trimming the heads accordingly. Provisions are made for key replacement by removal of the bottom cover machine screws.

Other features and objects of the invention will be apparent from the accompanying specification, claims and drawing.

BRIEF DESCRIPTION OF THE DRAWING

Other and more specific objects of the invention may be obtained from the key holder construction and features which are illustrated in the accompanying drawing, wherein.

DETAILED DESCRIPTION OF THE PREFERRED EMBODIMENTS

Figure 1:
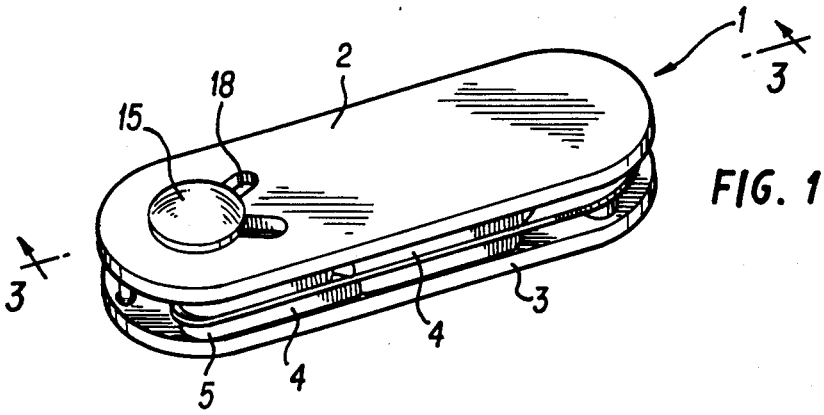
FIG. 1 is a perspective view of the key holder with all keys in storage.
Figure 3:
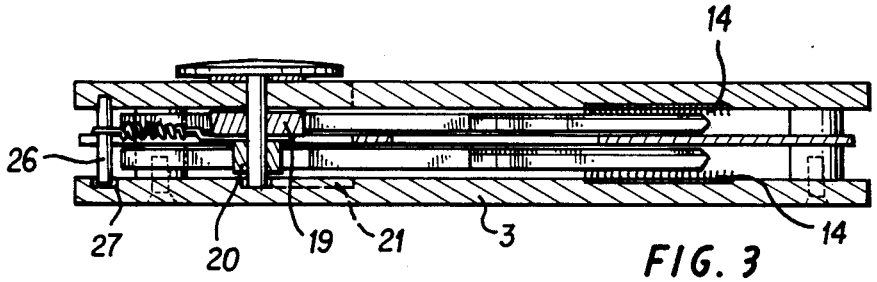
FIG. 3 is an enlarged, longitudinal, cross-sectioned view on the line 3—3 of FIG. 1.
Figure 2:
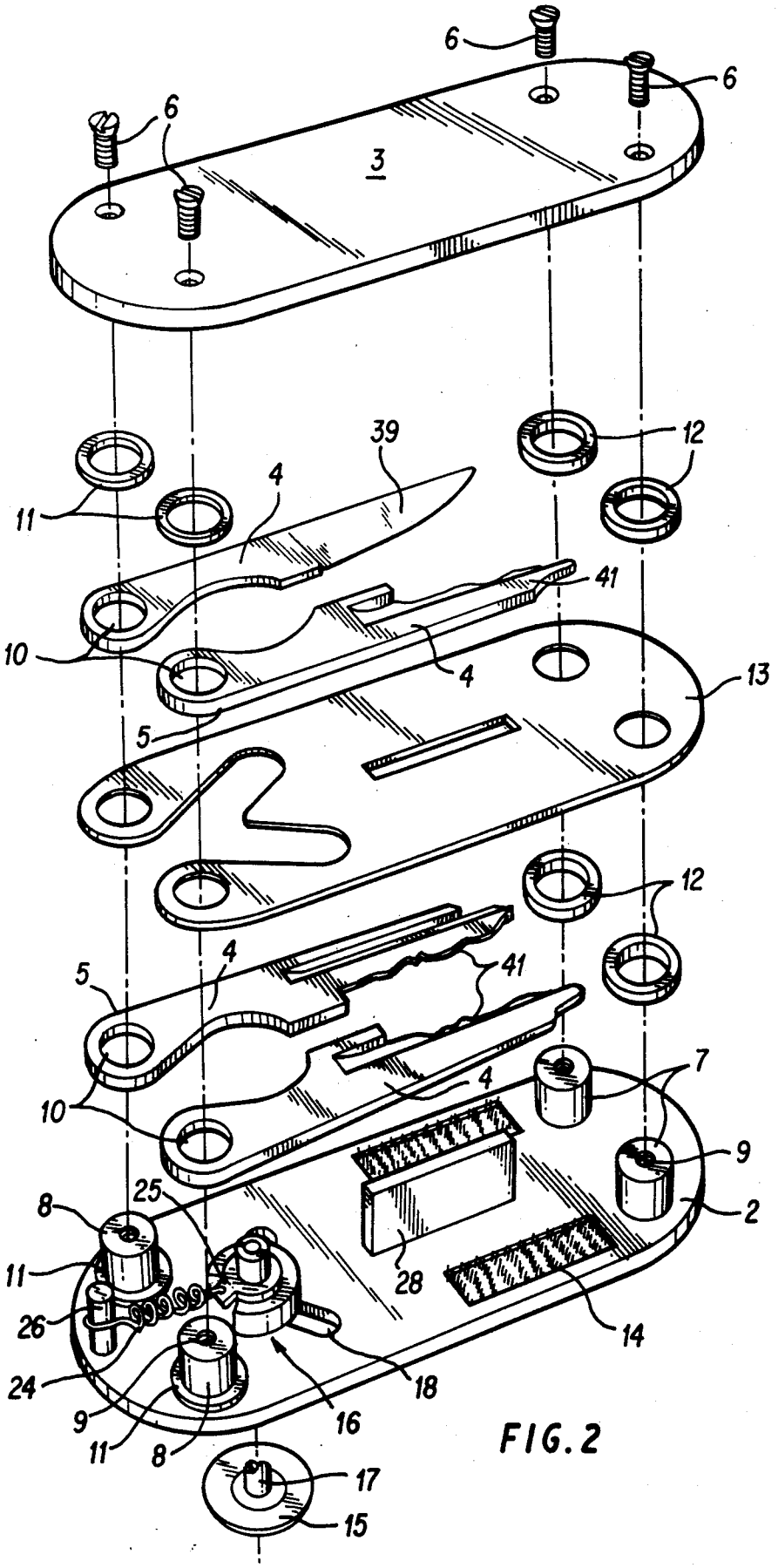
FIG. 2 is an exploded view of the key holder.

Referring to the drawing, FIG. 1 shows a key holder 1 contemplated by this invention as having unbreakable covers 2 and 3, preferably made of Formica, Micarta or other hard plastic. These covers may also be made of thin, non-corrosive metal. Covers 2 and 3 may be decorative and may carry advertising. The holder 1 of FIG. 1 has a capability of storing a maximum of four keys 4 of various lengths. As shown in FIGS. 1 and 2, the outside edge of the head of each key is trimmed at 5 so that each key is approximately parallel to the cover edge and is located just inside the holder 1 when stored. The ends of covers 2 and 3 are rounded to a radius equal to approximately one-half the width thereof, thus creating an attractive, compact holder which reduces the pocket bulge and the wear normally associated with other types of key holders.

Referring to FIG. 2, the holder may be easily disassembled by removing four, standard, flat-head machine screws 6. Posts 7 and 8 may be made from any of the same materials as used in making the covers 2 and 3. These posts 7 and 8 are drilled and tapped at 9 to receive standard machine screws 6. Keys 4 are mounted on posts 8 through circular openings 10 which are of a sufficient size to permit each key to turn freely without excessive play, thus inhibiting undue shifting of the keys. Keys 4 rotate on washers 11, preferably made of brass, which provide a bearing surface and also serve to space the body of each key from the inner surface of covers 2 and 3, thereby minimizing sliding resistance.

Spacers 12, which may be made of plastic material, are mounted over the posts 7 on opposite sides of a divider 13 and support this divider 13 in a position generally parallel to and midway between the cover members 2 and 3. These spacers 12 thus establish the distance between each cover member and the divider at one end of the holder. This space is set to be just slightly greater than the thickness of a key 4. The divider 13 serves to separate top and bottom keys 4 and to provide a smooth, sliding surface for the keys when being either ejected or returned to the holder 1. The divider 13 should be very thin and may be made of plastic or non-corrosive metal.

Strips 14 of a fabric pile material having a base layer and a plurality of protruding prickly fibers are embedded in each cover member 2 and 3 to a depth so that the prickly fibers protrude beyond the inner surface thereof by a distance sufficient to engage and retain the key. This pile material 14 may be obtained by cutting to a desired size, either layer of a Velcro fastening member or any other pile material whose fibers are flexible and resilient. Thus unwanted key movement is prevented while the keys 4 are stored, but is not excessive to the point of restricting the sliding action of the keys when being ejected or returned for storage. The resiliency of these fibers also aids in the initial movement of the key during its ejection. These strips 14 need only be of a minimum area sufficient to restrict unwanted key movement.

Keys 4 are ejected from the holder 1 by an angular movement of an actuator 15 which is integrally connected with an ejector assembly 16 via a common shaft 17 extending through a V-shaped slot 18 in cover member 2. The ejector assembly 16 comprises two stacked discs 19 and 20 and may be made of Formica, Micarta or non-corrosive metal. Ejector disc 19 has a thickness equal to the thicker top level key plus the thickness of the bearing washers 11. Ejector disc 20 has a thickness equal to the thickness of the thicker bottom layer key plus the thickness of the adjacent bearing washers 11. With ejector discs 19 and 20 secured on shaft 17, the end of the shaft 17 extends into the grouted area 21 of the bottom cover 3. The ejector disc 20 is attached to one end of shaft 17 by a threaded connection. The disc 20 may be welded or soldered to the end of shaft 17 after final adjustment.

The initial one-third movement of the actuator 15 along one side of the V-shaped slot 18 causes only the larger disc 19 to engage and move its key out of the holder 1. Continued movement of the actuator 15 causes disc 20 to engage and move its key 4 out of the holder while further moving the key associated with the disc 19. Thus the two keys 4 are offset from each other at all times during movement of the actuator 15. Similarly, movement of the actuator 15 through the other side of V-shaped slot 18 will move the other keys 4 in the same manner. Top keys adjacent to the cover 2 should always be the most actively used keys, such as for the house or for the car door and the ignition. If a bottom key is desired to be used, then the actuator 15 should be moved through the full length of the V-shaped slot 18. The outermost projecting top key 4 may then be manually rotated back into the holder 1, thereby isolating the desired bottom key in its exposed position.

Figure 5:
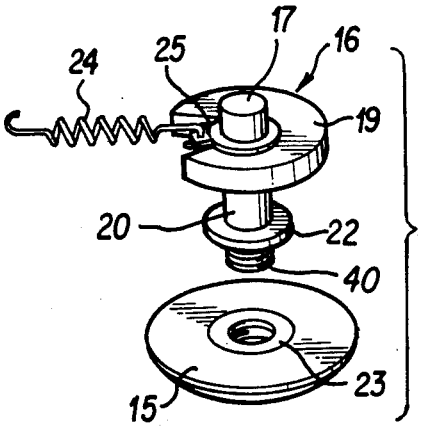
FIG. 5 is an enlarged perspective view of the actuator and ejector assembly, including an attached spring.

Ejector shaft 17 should be made of non-corrosive metal or the like with the end 40 threaded to engage actuator 15. As shown in FIG. 5, these threads extend to a flange 22 which thus provides a stop for connecting the shaft 17 to the actuator 15. Flange 22 should be flat and present a smooth surface in order to provide a good engagement with the inner face of actuator 15, as well as to provide a good bearing engagement with the outer surface of the cover member 2.

Actuator 15 may be dome shaped and of a diameter similar to the width of one's thumb so that a slight thumb pressure on the actuator 15 will produce the required forward movement of the ejector assembly 16. The base 23 of the actuator 15 should be flat to match the surface of the flange 22. The actuator 15 should be made of any material sufficiently strong so as to withstand a large number of repeated operations. Actuator 15 may be permanently attached to shaft 17 in a suitable manner, thereby eliminating any need for a threaded connection. Also, the actuator 15 and the shaft 17 may be integrally cast or molded as a single, one-piece unit, thus eliminating any separate connection between these two members. While the inner face of the flange 22 acts as a bearing surface upon the outer surface of the cover member 2, it is also possible to have the inner surface of the actuator 15 in direct engagement with the cover member 2, thus eliminating the flange altogether. The actuator 15 may obviously be made in an assortment of different designs and colors.

Figure 6:
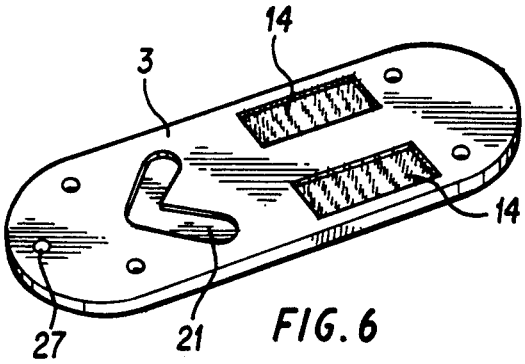
FIG. 6 is a perspective view of the inside of the bottom cover.

The apex of the V-shaped slot 18 is positioned near the key retaining posts 8 so that ejector assembly 16 will always contact only the head portion 5 of a key 4; hence, the teeth 41 of the keys are not adversely affected by any member of the holder 1. The sides of the V-shaped slot 18 are positioned at an angle of approximately 50° with respect to the elongated center line of the holder. This acute angle is critical in permitting the helical spring 24 to return the ejector assembly 16 easily to its initial position. In other words, it is desirable to have the line of movement for the spring close to the line of movement for the actuating mechanism, thereby minimizing wear on these moving parts. The width of the slot should only be sufficient to allow free movement of shaft 17 therein. The length of the slot 18 should provide for only that forward movement of the ejector assembly 16 which is needed to eject both the top and bottom keys properly. At rest, the ejector assembly is maintained at the apex of V-shaped slot 18 by a helical spring 24. One end of spring 24 is connected to tab 25 which is carried by the shaft 17, while the other end of spring 24 is attached to an anchor post 26. The spring 24 should be sufficiently strong to return the ejector assembly 16 adequately to its initial position after a key has been ejected, as well as to withdraw the assembly 16 from the path of any key being returned to the holder 1. Tension in the spring 24 should also be sufficiently adequate to prevent any rattling of the ejector assembly 16. Spring anchor post 26 is attached to the bottom inner side of top cover 2 and may be made from the materials used in making the covers 2 and 3. The end of anchor pin 26 is positioned in hole 27 (FIG. 6) in the inner surface of the bottom cover member 3. Since hole 27 is only slightly larger than the diameter of anchor pin 26, a tight fit is obtained, thus adding to the rigidity of the pin. The anchor pin 26 is located as close to the end of the holder as possible. This will maximize the length of the spring 24 being used and will thus permit the use of a relatively strong spring.

Member 28 further isolates one key from another of those keys which are located on the same level, whereby each key 4 is carried in a separate compartment. Member 28 may also be made of the same material used to make the covers 2 and 3 and should extend to a point just beneath the top posts 7 and 8.

Figure 7:
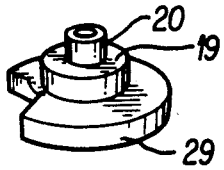
FIG. 7 is a perspective view of a three-tiered ejector.
Figure 13:
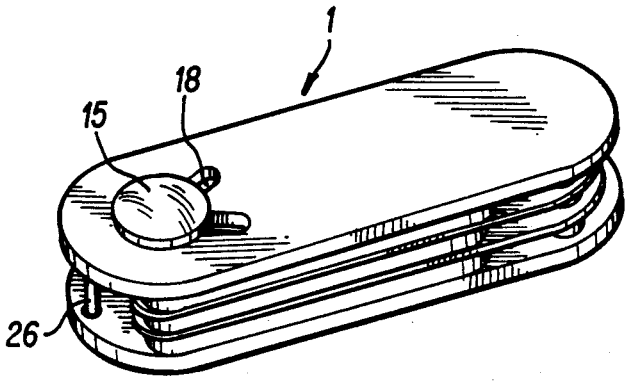
FIG. 13 is a perspective view of a modified key holder comprising a set of three keys along each side.

The foregoing description describes a key holder having a total of four keys, wherein each post 8 carries two keys. A holder having only one key per post may be made by providing shorter posts 7 and 8, a shorter shaft 17 and a shorter isolating member 28, plus only a single ejector disc. In this instance, the divider 13 and one set of spacers 12 are eliminated. Similarly, three keys per post may be accommodated by providing posts 7 and 8 to match the height of the three keys, along with a longer shaft 17, a wider isolating member 28 and a three-tiered ejector assembly 16, comprising discs 19, 20 and 29, as shown in FIG. 7. A second divider 13 and one additional spacer 12 for each post are required. FIG. 13 shows a holder 1 capable of carrying six keys.

Figure 8:
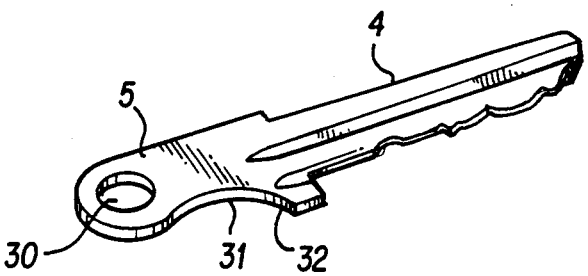
FIG. 8 is a perspective view of the standardized key.

FIG. 8 shows a standardized key 4 for my key holder. The head 5 is relatively narrow so as to be easily packaged in the holder and is provided with a circular opening 30. This opening should be only slightly larger than the diameter of posts 8, thereby minimizing undue shifting within the holder. The inner edge of the head of the key 4 is arcuately shaped at 31 to receive the disc of the ejector assembly 16 during ejection of the key from the holder. The radius of curvature of the arcuate surface 31 gradually decreases toward the end 32 thereof. This will maximize the distance that a key is ejected from the holder and will thus minimize the distance traveled by the actuator 15, the ejector assembly 16 and the spring 24.

Figure 9:
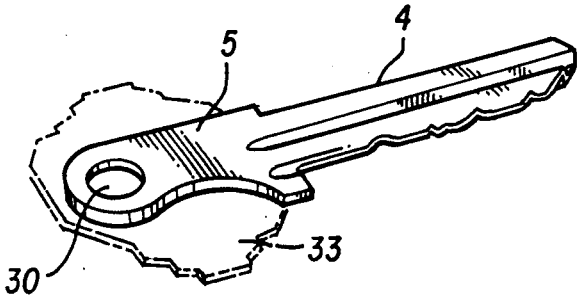
FIG. 9 is a perspective view showing how a coventional key may be modified, as shown by the broken lines, to approximate the standardized key configuration of FIG. 8.

FIG. 9 depicts how the head of a conventional key may be cut to shape the end thereof properly so as to be usable in my holder. That position 33 of the key which is shown by the dotted lines in FIG. 9 is removed. This shaping operation may be accomplished at a key supply outlet for a minimal cost. Thus it is readily apparent that conventional keys may be used in my holder, provided that the opening 30 of the conventional key is not too large for the post 8 of my holder.

Figure 11:
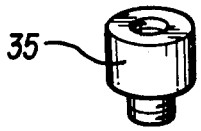
FIG. 11 is an enlarged perspective view of a two-key post extender.
Figure 10:
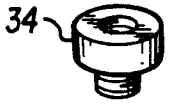
FIG. 10 is an enlarged perspective view of a single key post extender.

Extenders 34 and 35 are shown in FIGS. 10 and 11 respectively. When a set of four extenders 34 are fastened to posts 7 and 8, the holder will then be able to carry two additional keys. Extenders 35 will increase the length of the posts by a distance sufficient to carry four additional keys. This same result may also be accomplished by using two additional extenders for each post. It is, therefore, apparent that an abundant supply of extenders 34 may be stocked at a key supply outlet so that posts of any desired length may be made up at the same time that the key holder 1 is assembled. Thus the supply outlet would be able to stock a smaller number of different posts, but would still be able to supply key holders carrying two, four or six keys.

A "dummy" key is required if an odd number of keys are to be carried by my holder 1. This will result in the stack of keys on each side of the holder having the same number of keys. Therefore, each key in each stack will be assured of being maintained in proper engagement with its retainer member 14. If desired, other accessories such as a knife blade, a screwdriver, a fingernail file, etc. may be used instead of a "dummy" key. Likewise, an adequate number of these accessory members may be readily stocked at a key supply outlet. An example of an accessory member is shown in FIG. 2 by the knife blade 39.

Figure 12:
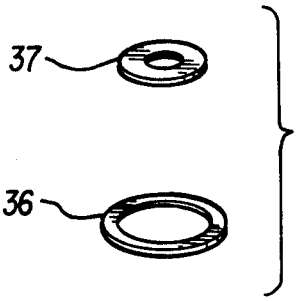
FIG. 12 is a perspective view of a set of shim washers.

Keys whose combined thickness is less than the standardized key thickness may require the use of shim washers to match the height of posts 7 and 8. Examples of these washers are shown in FIG. 12 at 36 and 37 and would be carried by the posts 8 to increase the key thickness effectively.

Figure 4:
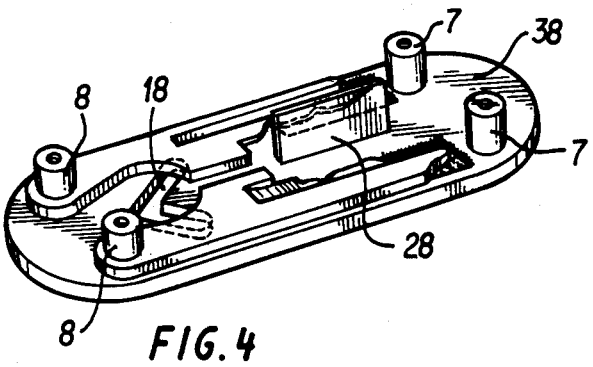
FIG. 4 is a partial perspective view of the inside of the top cover with ejector, bottom keys and bottom spacers removed.

As indicated in FIG. 4, the space 38 between the posts 7 at the far end of the holder may be utilized to carry a battery operated light (not shown) or a battery operated sound emitting device (also not shown). Alternatively, the sound emitter may be carried within the body of the actuator 15 and, of course, would be miniaturized along with its battery. The sound emitter would be responsive to a given plurality of sharp sounds, such as clapping one's hands three times or snapping one's fingers three times. The sound emitter would thus be useful in locating a "lost" or misplaced holder.

Due to the utilization of keys having a special head portion or of conventional keys modified to have a special head portion, it is preferred that the present key holder be stocked at key shops which are capable of performing the necessary cutting or shaping operation.

It is evident that I have provided an extremely practical key holder having a low manufacturing cost and a minimum of parts, thus assuring ease of operation in a device which is not only compact but also very attractive.

Since various changes may be made in the construction of this key holder without departing from the scope of my invention, it is intended that all matter contained in the foregoing description and shown in the accompanying drawing shall be interpreted as illustrative only.

I claim:

1. A key holder comprising a pair of spaced covers, a post located between and connected to said covers with said post being adapted to carry a pair of keys, an ejector assembly spaced from said post, movable means carried on an outer surface of one of said covers with said means being integrally connected to said ejector assembly by a member extending through an elongated slot in said one cover, said ejector assembly comprising a pair of disc-like elements having different diameters and being concentrically stacked on said member, the keys being located between a side of said one cover and said ejector assembly when carried on the post and said slot being spaced from said post and being angled toward said side of the cover in a direction away from the post, whereby movement of said means will produce a corresponding movement of said discs with each disc thus engaging and pivoting an individual key about its post from a stored position within the holder to an ejected position so that an end of the key projects outwardly from the said side of the cover and whereby the larger disc will eject its key to a position farther from the holder than the smaller disc.

2. The holder of claim 1, including a spring having a pair of ends with one end attached to said ejector assembly and the other end attached to an anchor post, said anchor post being located near the end of the holder adjacent said key carrying post and being positioned between said end and the slot, whereby said spring will automatically return the ejector assembly to a position of rest.

3. The holder of claim 1, including a second key carrying post with each of said posts adapted to carry a pair of pivotally mounted keys and said slot being V-shaped.

4. The holder of claim 1, including a fabric layer of pile material embedded in the inner surface of each cover, with the ends of the pile material projecting beyond the inner surface of the adjacent cover, said pile material positioned to engage and retain a key in its stored position.

5. The holder of claim 1, including a pair of keys carried on said post, the side of the head of each said key adjacent its disc being concave along the line of engagement with its disc and each disc adapted to move along said adjacent concave surface during ejection of each said key from the holder.

6. The holder of claim 1, wherein said post comprises a plurality of segments, detachably connected together, with each segment having a length generally equal to the thickness of a key, whereby a number of keys equal to the number of segments may be carried on said post.

7. The holder of claim 6, including a divider member positioned substantially parallel to said covers and carried on said post at a location approximately midway between the covers.

8. The holder of claim 7, wherein the number of discs is also equal to the number of post segments, and each disc has a different diameter than the other discs, whereby each disc will eject its key to a position from the holder different than each other disc.

9. The holder of claim 1, including a second post with each of said posts adapted to carry a pair of pivotally mounted keys, said slot being V-shaped, and said holder further including a spring having a pair of ends with one end attached to said ejector assembly and the other end attached to an anchor post, said anchor post being located near the end of the holder adjacent said first and second posts and being positioned between said end and the V-shaped slot, whereby said spring will automatically return the ejector assembly to a position of rest at a location adjacent the apex of the V-shaped slot.

10. The holder of claim 9, including a divider member positioned substantially parallel to said covers and carried on said first and second posts at a location approximately midway between the covers.

11. The holder of claim 10, including an additional divider member located between, and normal to, the covers and centrally positioned along the length of the holder, whereby a separate compartment is provided for each key.

12. The holder of claim 11, including a fabric layer of pile material embedded in the inner surface of each cover, with the ends of the pile material projecting beyond the inner surface of the adjacent cover, said first mentioned divider maintaining pressure upon, and the orientation of, each adjacent key, so that said pile material is capable of engaging and retaining an adjacent key in its stored position.

13. A holder comprising a pair of spaced covers, a pair of posts located between and connected to said covers at one end thereof, each of said posts adapted to carry a pair of pivotally mounted elongated members, an ejector assembly spacially located between said posts, movable means carried on an outer surface of one of said covers with said means being integrally connected to said ejector assembly by a member extending through an elongated slot in said one cover, said ejector assembly comprising a pair of disc-like elements having different diameters and being concentrically stacked on said member, said slot being V-shaped with the apex thereof being adjacent to, but spaced from, each of said posts and each leg of the V-shaped slot being angled toward a different side of said cover in a direction away from said posts, whereby movement of said means will produce a corresponding movement of the ejector assembly which thus engages and pivots a pair of elongated members about their post from a stored position within the holder to an ejected position, wherein an end of each said ejected elongated member a different distance projects outwardly from a side of said one cover member.

14. The holder of claim 13, wherein each of said posts is circular in cross-section and each elongated member adapted to be carried by a post comprises a key which is provided with a circular opening in its head, said circular post adapted to be positioned through the circular opening in the key.

15. The holder of claim 13, wherein each of said posts is circular in cross-section and one of the elongated members adapted to be carried by a post comprises a knife blade which is provided with a circular opening in its head, said circular post adapted to be positioned through the circular opening in the knife blade.

16. The holder of claim 13, including an elongated spring having one end attached to an anchor post and the other end attached to said ejector assembly, said anchor post located at a point offset from a line extending along the length of each leg of said V-shaped slot, whereby said spring causes the ejector to return to its initial position of rest adjacent the apex of the V-shaped slot.

17. An elongated key holder comprising a pair of spaced covers, a pair of posts located between and connected to said covers with each of said posts being adapted to carry a key, an ejector disc spaced from said posts, movable means carried on an outer surface of one of said covers with said means being integrally connected to one surface of said ejector disc by a member extending through a V-shaped slot in said one cover, said slot being spaced from each of said posts, each leg of said V-shaped slot being angled approximately 50° from the elongated center line of said one cover member, the inner surface of said other cover member being provided with a V-shaped recess, said recess being of the same size as said V-shaped slot and aligned therewith, said member having a terminal end portion projecting from the other surface of said ejector disc and being of a length and a dimension to be carried within said recess, an alongated helical spring having one end attached to an anchor post and the other end attached to said member, said anchor post located close to one end of said holder and being positioned between said one end and the V-shaped slot at a point offset from a line extending along the length of each leg of said V-shaped slot, said ejector disk having a notched recess facing said anchor post, a tab positioned within said notched recess and being secured to said member, said other end of said spring being attached to said tab, thereby maximizing the relative length of said spring, whereby movement of said means along either leg of said V-shaped slot will produce a corresponding movement of the ejector disc which thus engages and pivots one of a pair of laterally positioned keys about its individual spot from a stored position within the holder to an ejected position so that an end of the key projects outwardly from a side of the cover, said spring causes the ejector disc to return to its initial position of rest adjacent the apex of said V-shaped slot regardless of which leg said means was moved along.

* * * * *